US005773773A

United States Patent [19]

McCauley et al.

[11] Patent Number: 5,773,773

[45] Date of Patent: Jun. 30, 1998

[54] JOYSTICK WITH DETENT MECHANISM FOR TACTILE FEEDBACK CENTERING

[75] Inventors: Gilbert L. McCauley, Southfield; James E. Van Hout, Auburn Hills; Lee M. Dziekan, East Pointe, all of Mich.

[73] Assignee: Chrysler Corporation, Auburn Hills, Mich.

[21] Appl. No.: 155,564

[22] Filed: Nov. 22, 1993

[51] Int. Cl.[6] ..... H01H 25/04

[52] U.S. Cl. ..... 200/6 A

[58] Field of Search ..... 200/4, 5 R, 6 R, 200/6 A, 16 R, 17 R, 18, 329, 336

[56] References Cited

U.S. PATENT DOCUMENTS

| | | | |
|---|---|---|---|
| 2,623,142 | 12/1952 | Karl | 200/6 A |
| 3,169,172 | 2/1965 | Hagberg | 200/5 |
| 3,482,465 | 12/1969 | Lusted | 74/473 |
| 3,629,775 | 12/1971 | Kindred | 338/128 |
| 3,780,596 | 12/1973 | Takahashi et al. | 74/473 P |
| 4,230,916 | 10/1980 | Mochizuki | 200/6 A |
| 4,576,059 | 3/1986 | Nishu et al. | 74/473 P |
| 4,723,458 | 2/1988 | Blok | 74/471 XY |
| 4,784,008 | 11/1988 | Paquereau et al. | 74/471 XY |
| 5,151,563 | 9/1992 | Tanaka | 200/6 A |

OTHER PUBLICATIONS

*Patent Abstracts of Japan* (C–791), vol. 14, No. 578, Dec. 21, 1990 (abstract to JP–A–2–250977).

*Primary Examiner*—Michael L. Gellner
*Assistant Examiner*—Michael A. Friedhofer
*Attorney, Agent, or Firm*—Roland A. Fuller, III

[57] ABSTRACT

An arrangement for mounting a joystick wherein a ball having a spherical portion and a frustoconical portion is mounted in a cylindrical socket within a housing. A cap having a frustoconical surface complementing the frustoconical surface of the ball is mounted on the housing. An O-ring engages the spherical surface of the ball and urges the frustoconical surfaces into engagement. When the joystick is tilted relatively far, the spherical surface of the ball engages the frustoconical surface of the cap and retains the joystick in its tilted position; however, when the joystick is in a near-center position and is released, the frustoconical surfaces on the ball and on the cap are in engagement and cause the ball to snap back to the center position. This provides tactile feedback centering for the joystick.

5 Claims, 2 Drawing Sheets

JOYSTICK WITH DETENT MECHANISM FOR TACTILE FEEDBACK CENTERING

FIELD OF THE INVENTION

The present invention relates to a joystick control with a detent mechanism for tactile feedback centering. More particularly, the present invention relates to a joystick control with a detent mechanism for tactile feedback centering wherein the joystick is especially useful for electronic controls.

BACKGROUND OF THE INVENTION

Joysticks are now used to control various systems in automobiles and are especially useful in controlling speaker fade in audio systems. In addition to controlling speaker fade, joysticks control side view mirrors. The possibility of using joysticks to control power windows is being explored.

As with other automotive components there is a constant effort to reduce cost while improving reliability and quality. A slight reduction in cost in an automotive component which is widely used can result in very large savings because so many units are manufactured and sold. In the automotive industry, reliability is very important both in cost control and customer satisfaction. One way to both reduce costs and improve reliability is to reduce the number of components in a device and to simplify its operation.

Prior joystick controls for speaker fade in audio systems have tended to be relatively complex requiring relatively complex structure to accomplish centering. In electrical joystick controls, it is important once the joystick is released proximate its center position, that it assume the center position so that it does not accidentally establish electrical contact. It is necessary that the joystick be held in this position securely because, as automotive vehicles travel, they hit bumps and change direction, subjecting joysticks to forces and vibrations which the joysticks should resist. While doing this, the joystick should preferably respond smoothly to tactile control when moved and then remain in its center position when returned thereto.

SUMMARY OF THE INVENTION

In view of the aforementioned considerations, it is a feature of the present invention to provide a new and improved joystick with tactile centering wherein the joystick is mounted with a minimal number of inexpensive components.

In view of this feature and other features, the present invention is directed to a joystick, useful for operating electronic systems such as audio systems, wherein the joystick includes a mounting ball which is spherical over a first portion and is frustoconical over a second portion. The ball is received in a cylindrical socket with the spherical portion thereof engaged by an O-ring seated in the cylindrical socket. The cylindrical socket is covered by a cap having an opening through which the joystick projects and a concave frustoconical surface which complements the convex frustoconical surface of the ball. When the joystick is tilted through a relatively large angle, the O-ring urges the spherical surface of the ball against the frustoconical surface of the cap thereby retaining the joystick in its tilted position; however, when the joystick is moved near the center position, the frustoconical surface on the ball and on the cap engage and tend to snap the ball to its center position when released. In the center position, the axis of the joystick assumes a position perpendicular to the O-ring.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
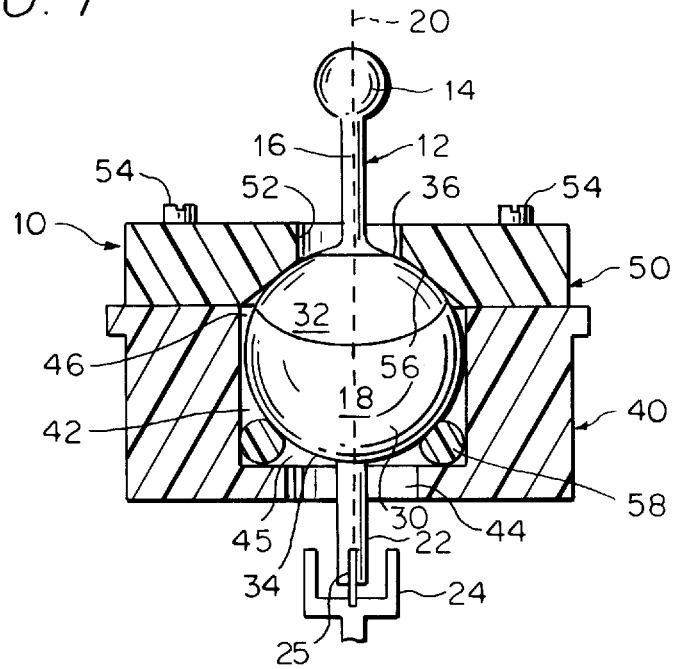
FIG. 1 is a side elevation showing a joystick mounted in accordance with the principles of the instant invention.
Figure 2:
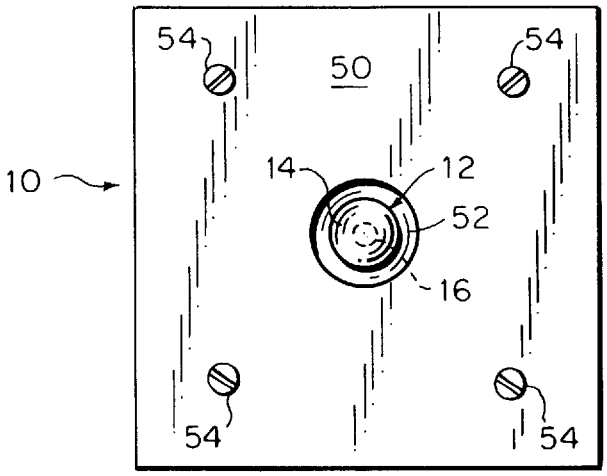
FIG. 2 is a top view of the joystick and mounting arrangement of FIG. 1.

Referring now to FIGS. 1 and 2, there is shown an arrangement 10 for mounting a joystick 12, wherein the joystick includes a handle or knob 14 connected by a stem 16 to a ball 18. The stem 16 is aligned with an axis 20 which also has an activating stem 22 porjecting from the ball 18 aligned therewith. When the joystick 10 is used to control fade in an audio system, the activating stem 22 is juxtaposed with two conventional fork contacts 24 and 25 disposed radially in spaced relation with respect to the contact stem 22. Upon moving the knob 14 radially with respect to the axis 20, the joystick 12 tilts, causing the contact stem 22 to move one of the contacts 24 or 25 in a conventional manner. In a conventional manner, the contact 24 controls fade with respect to the front and rear speakers (not shown), while the contact 25 controls fade with respect to left and right speakers.

In another use, the contracts could operate an electrical device such as a motor in order to drive or position an accessory for an automobile such as, for example, a pair of side mirrors.

In accordance with the principles of the instant invention, the ball 18 has a spherical portion 30 and a convex frustoconical portion 32 which have spherical and frustoconical surfaces 34 and 36, respectively. The ball 18 is mounted in a housing 40 which has a cylindrical socket 42 therein. The cylindrical socket 42 has a circular opening 44 at one end thereof through which the contact stem 22 projects and a base 45. A circular opening 46 is located at the other end of the socket 42 through which the convex frustoconical portion 32 of the ball projects. A cap 50 having an opening 52 through which the stem 16 of the joystick 12 projects is secured to the housing 40 by a plurality of screws 54. The opening 52 includes a concave, frustoconical surface 56 which complements the convex frustoconical surface 36 of the ball 18.

Positioned on the base 45 of the socket 42 is an O-ring 58 which engages the spherical surface 34 of the ball. The O-ring 58 is compressed by cap 50 due to the frustoconical surface 56 engaging the frustoconical surface 36 of the ball. The pressure of the O-ring 58 against the ball 18 thus seats the ball with the axis 20 of the joystick 12 extending perpendicular to O-ring 58. Accordingly, the joystick 12 is resiliently maintained in the center position of FIG. 1.

Figure 3:
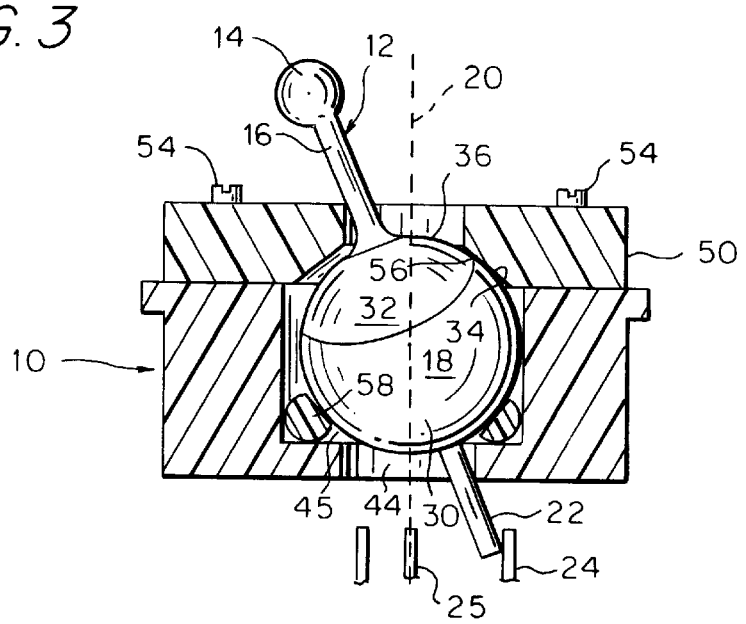
FIG. 3 is a side elevation similar to FIG. 1 showing the joystick fully tilted.

Referring now to FIG. 3, when the joystick 12 is tilted so that the spherical surface 34 is urged against the frustum 56, the ball 18 retains the joystick 12 in its tilted orientation. When the joystick is released, the O-ring 58 continues to exert sufficient force so that the joystick remains in the position of FIG. 3.

Figure 4:
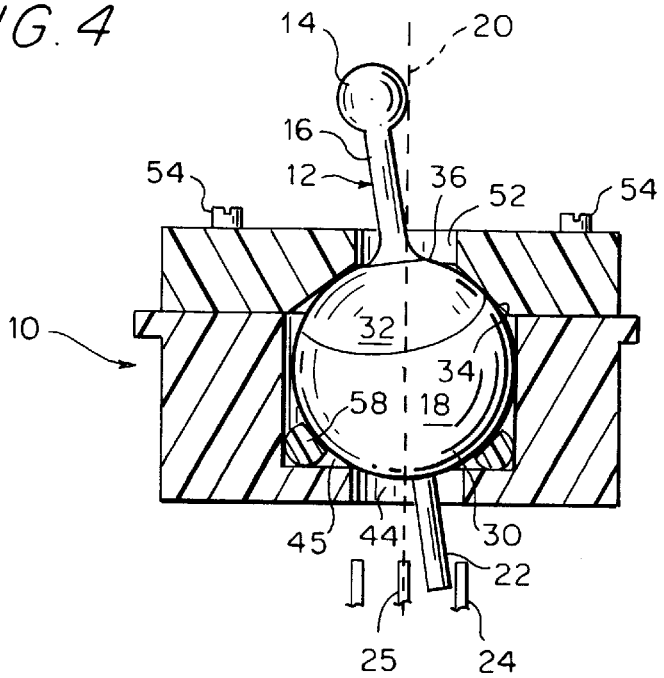
FIG. 4 is a side elevation similar to FIGS. 1 and 3 showing the joystick at its near center position.

Referring now to FIG. 4, when the joystick is moved back toward a near-center position wherein the frustoconical surface 36 on the ball engages the frustoconical surface 56 on the cap 50, the ball 18 will be forced by the urging of O-ring 58 back to the center position of FIG. 1.

In accordance with a preferred embodiment, the O-ring 58 is made of a resilient elastomer such as rubber, silicon rubber or other elastic material while the housing 40 and cap 50 are made of a plastic material such as ABS. The joystick 12 with the integral ball 18 and contact stem 22 are preferably also made of a plastic material which is relatively stiff and robust, but may for some uses be made of metal.

The resulting joystick control provides tactile feedback centering, is inexpensive to manufacture and robust in construction.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A joystick control comprising:

a ball having an axis on which a contact stem and joystick stem are aligned, the ball having a spherical portion from which the contact stem exends and a frustoconical portion unitary with and axially aligned with the spherical portion from which the joystick extends;

a housing having a socket therein for receiving the ball;

a frustoconical surface in the housing complementing the frustoconical surface of the ball and being positioned against the frustoconical surface of the ball; and a resilient member in the form of O-ring positioned with the socket for engaging the spherical portion and for urging the frustoconical surface of the ball into engagement with the frustoconical surface in the housing whereby the ball is urged to a centered position.

2. The joystick of claim 1, wherein the socket is cylindrical.

3. The joystick of claim 2, wherein the frustoconical surface is on a cap mounted on the housing and wherein the frustoconical surface on the cap is urged against the ball.

4. The joystick arrangement of claim 3, wherein a plurality of contacts are disposed around the contact stem in radial spaced relation to the contact stem.

5. The joystick arrangement of claim 4, wherein the contacts are in the form of contact forks used to control speaker fade in an automotive audio system.

* * * * *